United States Patent [19]

Hidaka et al.

[11] 4,375,923

[45] Mar. 8, 1983

[54] ROTATABLE PRINT HEAD FOR A MULTIPLE PRINT STATION PRINTING APPARATUS

[75] Inventors: Kenjiro Hidaka, Los Angeles, Calif.; Nicholas Kondur, Jr., Westminster, Colo.

[73] Assignee: C. Itoh Electronics, Inc., Los Angeles, Calif.

[21] Appl. No.: 199,118

[22] Filed: Nov. 5, 1980

[51] Int. Cl.[3] ..... B41J 3/54

[52] U.S. Cl. ..... 400/82; 400/229

[58] Field of Search ..... 101/96, 102, 100; 400/218-200, 220.1, 220.2, 229, 236.1, 124, 82, 149

[56] References Cited

U.S. PATENT DOCUMENTS 3,872,789 3/1975 Ambrosio ..... 101/93.29

4,167,345 9/1979 Englund et al. ..... 400/320 X

OTHER PUBLICATIONS

IBM Technical Disclosure Bulletin; vol. 21, No. 8, Jan. 1979; Pivot—Head Multi-Station Printer; A. C. Thorpe.

*Primary Examiner*—A. J. Heinz

*Attorney, Agent, or Firm*—W. Edward Johansen

[57] ABSTRACT

The present invention is a rotatable print head in combination with a multiple print station printing apparatus which includes a movable carrier to which the rotatable carrier is pivotally coupled by an axial rod so that the rotatable print head may rotate substantially an angle of 90°, a frame and a driving mechanism which is mechanically coupled to the frame and which drives the movable carrier laterally across the frame in a direction, which is parallel to the axis of rotation of the rotatable print head. The printing apparatus also includes a first platen the print surface of which is disposed in a first plane which is substantially vertical and parallel to the axis of rotation of the rotatable print head and a second platen the print surface of which is disposed in a second plane which is substantially horizontal and also parallel to the axis of rotation of the rotatable print head whereby the rotatable print head may rotate into printing alignment with either the first platen or the second platen. The printing apparatus further includes a rotating mechanism which rotates the axial rod thereby rotating the rotatable print head and which is mechanically coupled to the movable carrier.

3 Claims, 7 Drawing Figures

Fig. 1.
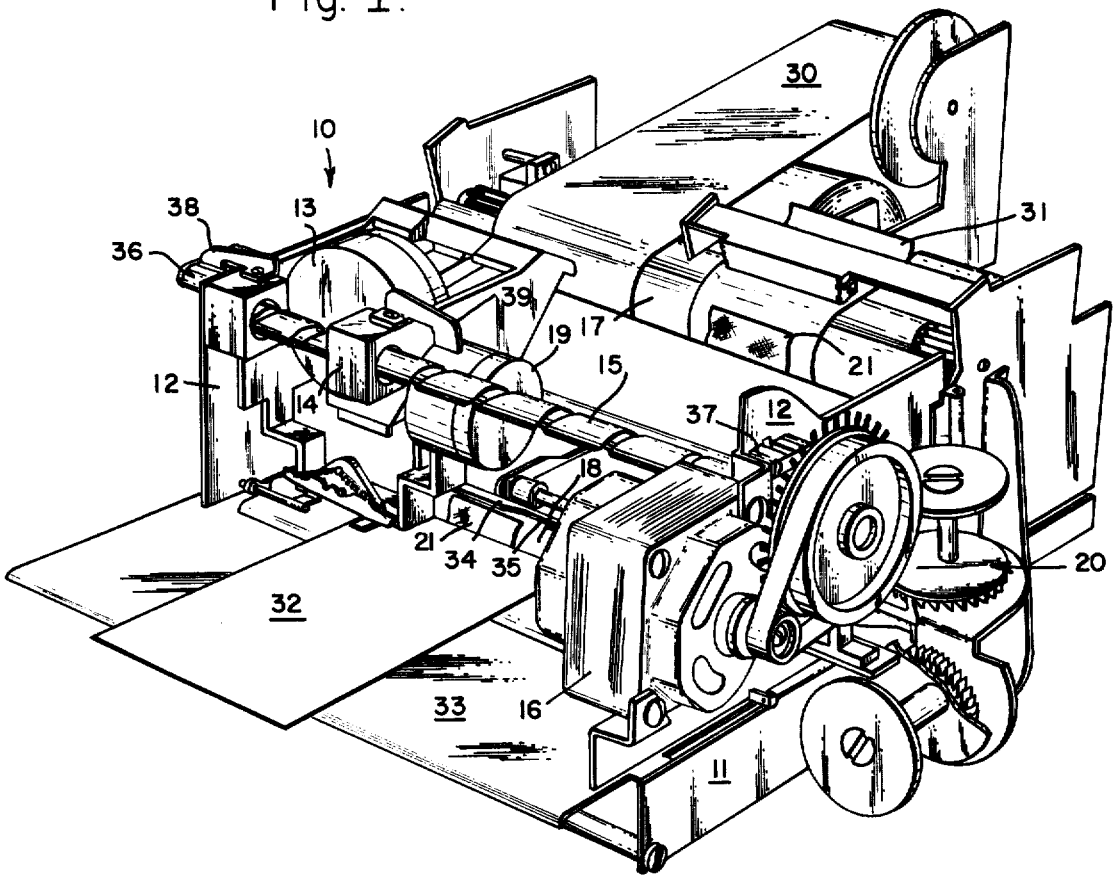
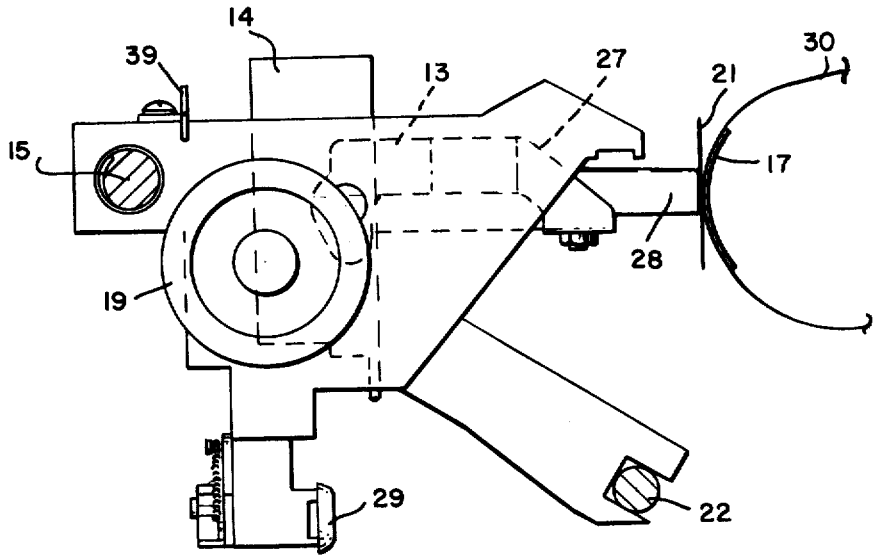
Fig. 2.

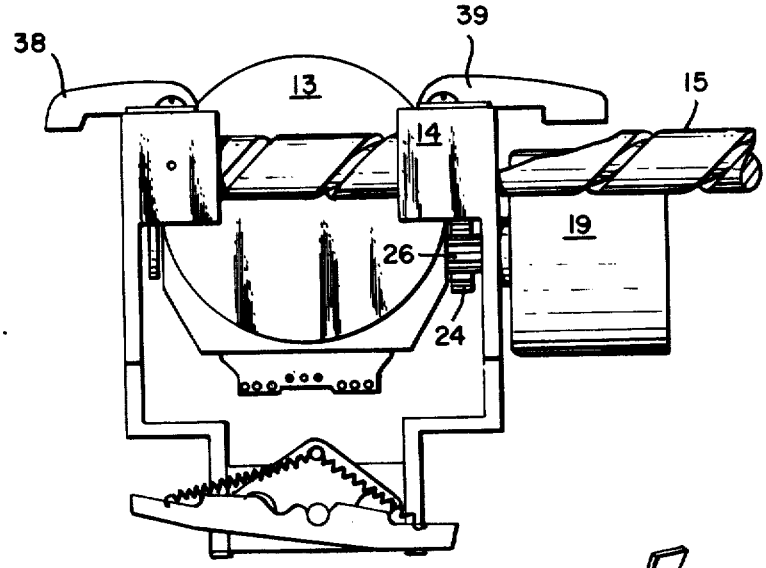
Fig. 3.
Fig. 5.
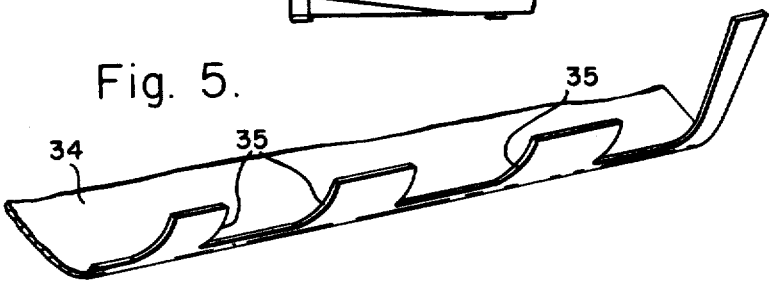
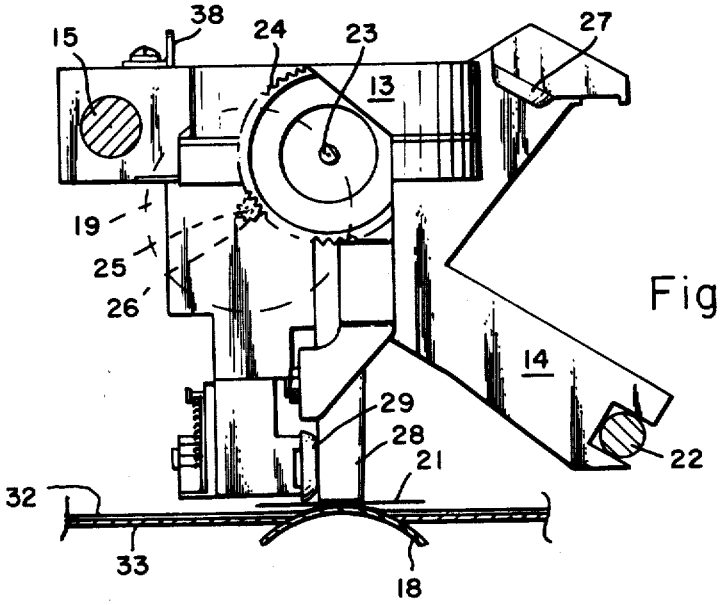
Fig. 4.

ROTATABLE PRINT HEAD FOR A MULTIPLE PRINT STATION PRINTING APPARATUS

BACKGROUND OF THE INVENTION

1. Field of the Invention

The present invention relates to a multiple print station printing apparatus which has a movable carrier having a rotatable print head and more particularly where the rotatable print head can print on print media in a plurality of different planes.

2. Description of the Prior Art

U.S. Pat. No. 4,082,035, entitled High Speed Printer Having Segmented Drum, issued to Gosta Roland Englund on Apr. 4, 1978, teaches a printing apparatus for printing characters onto a print medium which includes at least one printing station, a carrier which supports a plurality of segments that are included in the characters and a device for feeding the print medium through the printing station. The carrier is arranged to move the segments in sequence through the printing station. The printing apparatus also includes an actuator for actuating the print medium when a selected one of the segments on the carrier is located in the printing station. The device for feeding is arranged to feed the print medium intermittently through the printing station and the actuator is arranged to be activated when the print medium takes its rest position. The printing apparatus is housed in a casing and has a slot, from which a printed receipt may be obtained, and a window, through which a check ribbon or a journal print medium for audit purposes can be seen. The printing apparatus also has a slip table, in which a bill may be inserted. The printing apparatus has three spaced apart printing stations, one of which prints on a print medium which is orthogonally disposed to the other print media.

U.S. Pat. No. 4,027,765, entitled Record Media Drive Mechanism, issued to Leslie L. Crump and Victor J. Italiano on June 7, 1977, teaches a plurality of printing stations which are spaced across a printing apparatus wherein a feed or drive assembly for a print medium is associated with each printing station. Each of the feed or drive assemblies is self-contained and of modular construction in order to enable positioning of a particular feed or drive assembly in any desired location along a drive shaft. One feed or drive mechanism includes a clutch member and associated drive gears and rollers to incrementally advance a print medium, such as receipt paper, in one direction. A second feed or drive mechanism includes the clutch member and additional drive gears and rollers to incrementally advance a second print medium, such as journal paper in the same direction for rewinding and storage thereof in the printing apparatus. A third feed or drive mechanism includes the clutch member and further drive gears and rollers to incrementally advance a third print medium, such as slip or form paper in the opposite direction. In the modern business machine, a normal or common type of construction may include a receipt station, a journal or audit station and a slip or form station, wherein, respectively, a receipt is printed and provided to the customer, a journal or an audit is printed and retained or stored in the business machine, and a slip or form, which may be in the manner of a pass book or a document, is inserted and certain information is printed thereon and then returned to the customer, if it is a pass book, or deposited in a receptacle for further processing, if it is a check or similar document. U.S. Pat. No. 3,825,681 also discloses several printing stations which are adjacent to one another for performing these several functions. U.S. Pat. No. 4,027,765 teaches a single print head which operates across each printing station. The print medium at each of the printing stations is disposed in the same plane as the other print media.

U.S. Pat. No. 3,910,396, entitled Business Machine Printer Having Plural Print Heads, issued to Albert L. Eischen and George Kolomayeta on Oct. 7, 1975, teaches a high speed serial printing apparatus for business machines which includes a plurality of platens each of which backs an associated print medium, a continuous Mobius inked ribbon, a carriage which is movable relative to the platens and a plurality of print heads which are mounted on the carriage. Each print head has a set of selectively movable printing elements which are cooperable with the inked ribbon to impactingly print on the print medium associated with one of the platens. The print heads are mounted back to back on the carriage in opposing spatial relationship and are offset with respect to each other and the carriage so that each print head impactingly engages the Mobious loop inked ribbon along each of two parallel printing paths thereon, in order to effect substantially even ribbon wear and best inking characteristics, regardless of the relative usage of the print heads.

U.S. Pat. No. 4,167,345, entitled Printing Apparatus with Selectively Movable Printing Heads, issued to Gosta R. Englund and Karl T. Wincent on Sept. 11, 1979, teaches a printing apparatus for printing characters on at least one data carrier or print medium which includes a print head which is movable along the data carrier or print medium, a line advance device for feeding the data carrier or print medium substantially perpendicular to the moving direction of the print head, an inked ribbon feed mechanism for feeding an inked ribbon in relation to the data carrier or print medium, a cut-off mechanism for cutting off the data carrier or print medium, and a shaft which is rotatable less than 360° in one direction by a reversible motor from a home position to an end position which is determined by the selected operation cycle and thereafter back to the home position by reversing the direction of rotation of the shaft. The reversal of the shaft is performed at different times during subsequent operation cycles in order to permit gears and cams on the shaft to move the print head to positions which are determined by the number of characters to be printed on the data carrier or print medium, actuation of the line advance device and actuation of the inked ribbon feed mechanism or cut-off mechanism. A unit for printing normally unchanging information is activated in response to the motor providing a short backing movement before operation of the cut-off mechanism and before the print head is moved from the neutral position.

All of the above patents teach a plurality of print stations in most of which the print media are generally in the same plane. U.S. Pat. No. 3,910,396 teaches two printing stations in which the print media are parallelly disposed. U.S. Pat. No. 4,082,035 teaches three printing stations each of which has its own printing device and in which one of the three media is disposed orthogonally to the other two print media. It is often more convenient to have the slip printing station disposed perpendicular to the receipt printing station, but in view of the trend toward a more compact printing apparatus and less mechanical complexity thereof the required addition of a second orthogonally disposed printing device increases both the volume and the complexity of the printing apparatus.

SUMMARY OF THE INVENTION

In view of the foregoing factors and conditions characteristic of the prior art it is the primary object of the present invention to provide a printing apparatus which has a single print head and a plurality of printing stations, one of which has its print medium disposed in a plane which is at angle with respect to the other plane in which the print media of the other printing stations are disposed.

It is another object of the present invention to provide a printing apparatus which provides a mechanism for driving a single movable print head which not only makes the printing apparatus more compact, but also reduces the mechanical complexity of the printing apparatus.

It is still another object of the present invention to keep the printer control and print head drive from becoming more complex by utilizing a single rotatable print head for a multiple print station printing apparatus rather than using multiple print heads the use of which multiplies the circuit complexity.

In accordance with an embodiment of the present invention a rotatable print head in combination with a multiple print station printing apparatus has been described. The printing apparatus includes a movable carrier to which the rotatable carrier is pivotally coupled by an axial rod so that the rotatable print head may rotate substantially an angle of 90°, a frame and a driving mechanism which is mechanically coupled to the frame and which drives the movable carrier laterally across the frame in a direction, which is parallel to the axis of rotation of the rotatable print head. The printing apparatus also includes a first platen which is substantially vertical and disposed in a first plane which is parallel to the axis of rotation of the rotatable print head and a second platen the print surface of which is disposed in a second plane which is substantially horizontal and parallel to the axis of rotation of the rotatable print head whereby the rotatable print head may rotate into printing alignment with either the first platen or the second platen. The printing apparatus further includes a rotating mechanism which rotates the axial rod thereby rotating the rotatable print head and which is mechanically coupled to the movable carrier.

The features of the present invention which are believed to be novel are set forth with particularity in the appended claims.

Other objects and many of the attendant advantages of this invention will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a perspective drawing of a multiple print station printing apparatus which has a rotatable print head which has been constructed in accordance with the principles of the present invention.

FIG. 2 is a side elevational view of a movable carrier of the multiple print station printing apparatus of FIG. 1 for laterally moving the rotatable print head across the printing apparatus with the rotatable print head in its first position.

FIG. 3 is a front elevational view of the movable carrier of FIG. 2.

FIG. 4 is a side elevational view of the movable carrier of FIG. 2 with the rotatable print head in its second position.

FIG. 5 is a perspective drawing of a media guide which is used in conjunction with a slip table of the multiple print station printing apparatus of FIG. 1.

DESCRIPTION OF THE PREFERRED EMBODIMENT

Figure 6:
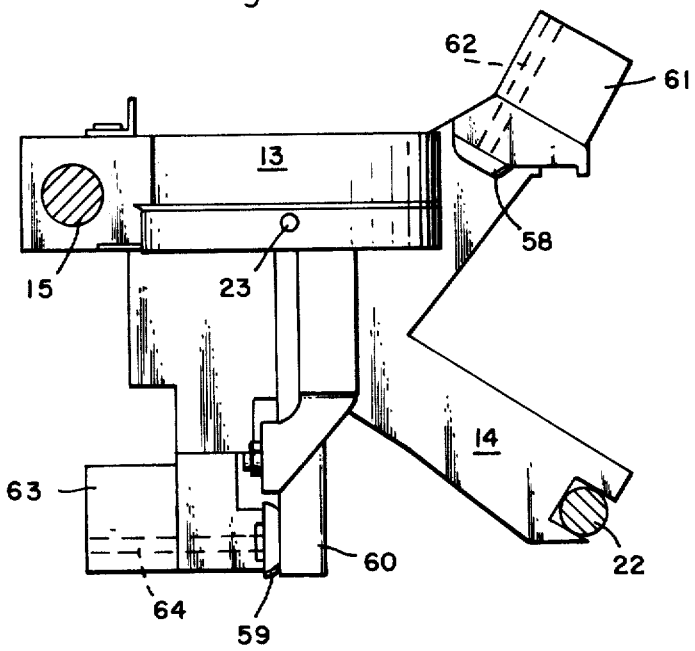
FIG. 6 is a side cross-sectional view of a movable carrier of a second embodiment of the multiple print station printing apparatus which uses a pair of solenoids and a pair of magnetic plates to rotate the rotatable print head.

In order to best understand the present invention it is necessary to refer the following detailed description of its preferred embodiment in conjunction with the accompanying drawing. Referring to FIG. 1 a multiple print station printing apparatus 10 includes a frame 11 having a pair of side plates 12 and a rotatable print head 13 which is pivotally coupled to a movable carrier 14. The printing apparatus 10 also includes a rotative drive shaft 15 which drives the movable carrier 14 and the rotatable print head 13 laterally, back and forth, across the frame 11. A first bi-directional motor 16 drives the rotative shaft 15. U.S. Pat. No. 4,167,345 and U.S. Pat. No. 4,027,765 teach similar rotative drive shafts.

In other embodiments of the present invention other mechanisms for moving the movable carrier 14 laterally, back and forth, across the frame 11 may be used in place of the rotative drive shaft 15 and the first bi-directional motor 16. U.S. Pat. No. 4,203,679, entitled Print Head Control, issued to Jonathan H. Duerr and Anthony C. Twitchen on May 20, 1980, teaches one of these mechanisms. U.S. Pat. No. 4,203,680, entitled High-Speed Printer with Self-Adjusting Cable Preload Mechanism, issued to Svetislav Mitrovich on May 20, 1980, teaches another of these mechanisms which includes a cable and a bi-directional motor which are mechanically coupled to a carrier for carrying a print head in order to move the carrier and the print head laterally, back and forth, across the frame 11. In still other embodiments of the present invention the movable carrier 14 may be driven laterally, back and forth, across the frame 11 by a set of gears and a bi-directional motor.

The printing apparatus 10 further includes a first platen 17 which is rigidly coupled to the frame 11 and the print surface of which is disposed in a first plane which is vertical and parallel to the rotative drive shaft 15 and a second platen 18 which is rigidly coupled to the frame 11 and the print surface of which is disposed in a second plane which is horizontal and parallel to the rotative drive shaft 15.

In other embodiments of the present invention the print surface of the first platen 17 may be disposed in a plane so that it slants slightly from the vertical plane and the print surface of the second platen 18 may be disposed in a plane so that it slants slightly from the horizontal plane in order to allow the operator to confortably view and handle the print media. A second bi-directional motor 19 may rotatively drive the print head 13 from its printing alignment with the first platen 17 to its printing alignment with the second platen 18. The second bi-directional motor 19, when reversed, may rotatively drive the print head 13 from its printing alignment with the second platen 18 to its printing alignment with the first platen 17. In the preferred embodiment of the present invention the same amount of current for turning the second bi-directional motor 19 continues to be fed thereto in order to maintain the rotatable print head 13 in either of its first or second printing alignment with either the first or second platen, 17 or 18, respectively. In other embodiments of the present invention, a mechanical latch may be used to secure the rotatable print head 13 in its proper printing alignment with each of the respective platens 17 and 18. In still other embodiments of the present invention a set of springs may resiliently bias the print head 13 so that it is in its proper printing alignment with each of the respective platens 17 and 18.

The print head 13 may rotate independently of the first bi-directional motor 16 which laterally drives the movable carrier 14 into printing alignment with either the first platen 17 or the second platen 18 through the rotative shaft 15. The second bi-directional motor 19 drives the rotatable print head 13.

The printing apparatus 10 may include an inked ribbon advance and reverse mechanism 20 for advancing an inked ribbon 21 if the printing apparatus 10 is printing on a print medium which requires an inked ribbon 21. If a print medium, such as a pressure sensitive paper, does not require an inked ribbon, then the printing apparatus 10 does not need to include an inked ribbon advance and reverse mechanism 20. U.S. Pat. No. 3,910,396 teaches an inked ribbon advancement mechanism for a printing apparatus having a plurality of print heads. U.S. Pat. No. 4,082,035 teaches a plurality of print heads each of which has its own inked ribbon advance and reverse mechanism. U.S. Pat. No. 3,825,103, entitled High-Speed Printer Having Improved Ribbon Driving, Reversing and Tensioning Mechanism, issued to Arthur F. Riley on July 24, 1974, teaches an inked ribbon advance and reverse mechanism. U.S. Pat. No. 4,027,765 teaching a printing apparatus with a plurality of print stations which has a movable print head and an inked ribbon cassette which is mechanically coupled to the movable print head. U.S. Pat. No. 4,167,345 teaches a printing apparatus with a plurality of printing stations which has a movable print head and an inked ribbon advance and reverse mechanism.

Referring now to FIG. 2 in conjunction with FIG. 1 the movable carrier 14 also travels along a guide shaft 22 which is disposed between the side plates 12. The guide shaft 22 and the rotative drive shaft 15 act in concert to maintain the movable carrier 14 in proper alignment so that the rotatable print head 13 may be in its printing alignment with either the first platen 17 or the second platen 18.

Referring to FIG. 2 in conjunction with FIG. 3 and FIG. 4 the rotatable print head 13 is pivotally coupled to the movable carrier 14 by an axial rod 23 which is fixedly coupled to the rotatable print head 13. A first gear 24 is axially aligned with and fixedly coupled to the axial rod 23. The second bi-directional motor 19 has a shaft 25 which is axially aligned with and fixedly coupled to a second gear 26. The first gear 24 and the second gear 26 are disposed so that the teeth of the first gear 24 engage the teeth of the second gear 26. The second bi-directional motor 19 rotatively and bi-directionally drives the rotatable print head 13 through its shaft 25, the second gear 26, the first gear 24 and the axial rod 23.

Referring still to FIG. 2 the second bi-directional motor 19 rotatively drives the rotatable print head 13 to its printing alignment with the first platen 17. Referring now to FIG. 4 in conjunction with FIG. 2 the movable carrier 14 has a first print head stop 27 which is disposed so that the print wire casing 28 of the rotatable print head 13 contacts the first print head stop 27 when the rotatable print head 13 is in its printing alignment with the first platen 17. The second bi-directional motor 19, which continues to be fed the same amount of current for turning the second bi-directional motor 19, forces the print wire casing 28 of the rotatable print head 13 against the first print head stop 27 thereby maintaining the rotatable print head 13 in its proper printing alignment with the first platen 17.

Referring to FIG. 4 the second bi-directional motor 19 rotatively drives the rotatable print head 13 to its printing alignment with the second platen 18. Referring now to FIG. 4 in conjunction with FIG. 2 the movable carrier 14 has a second print head stop 29 which is disposed so that the print wire casing 28 of the rotatable print head 13 contacts the second print head stop 29 when the rotatable print head 13 is in its printing alignment with the second platen 18. The second bi-directional motor 19, which continues to be fed the same amount of current for turning the second bi-directional motor 19, forces the print wire casing 28 of the rotatable print head 13 against the second print head stop 29 thereby maintaining the rotatable print head 13 in its proper printing alignment with the rotatable print head.

Referring now to FIG. 5 in conjunction with FIG. 1 and FIG. 2 the printing apparatus 10 has three print stations. The first print station is a journal station in which a first print medium 30 is disposed adjacent to the first platen 17. When the rotatable print head 13 is in its printing alignment with the first platen 17 for printing on the first print station the first print medium 30 is disposed between the print head 13 and the first platen 17. The second print station is a receipt station in which a second print medium 31 is also disposed adjacent to the first platen 17. When the rotatable print head 13 is in its printing alignment with the first platen 17 for printing on the second print station the second print medium 31 is also disposed between the print head 13 and the first platen 17. The third print station is a slip station in which a third print medium 32 is placed on a slip table 33, which is disposed adjacent to the second platen 18. When the rotatable print head 13 is in its printing alignment with the second platen 18 the third print medium 32 is disposed between the rotatable print head 13 and the second platen 18 on the slip table 33. The printing apparatus 10 has a media guide 34, which has a plurality of slots 35, fixedly coupled adjacent to the second platen 18. The plurality of slots 35 in the media guide 34 are aligned so as to allow the print wire casing 28 to clear the media guide 34 as the rotatable print head 13 is rotated from its printing alignment with the first platen 17 to its printing alignment with the second platen 18 or vice versa. The plurality of slots 35 in the media guide 34 enables the second bi-directional motor 19 to rotate the rotatable print head 13 not only at either the left or right end of the lateral movement of the movable carrier 14, but also between the journal and receipt stations.

The position of the movable carrier with respect to the plurality of slots 35 in the media guide 34 determines whether or not the rotatable print head 13 can be rotated into its printing alignment with either the first platen 17 or the second platen 18.

The printing apparatus 10 also has a first optical sensor 36 and a second optical sensor 37 which are attached to the side plates 12. The movable carrier 14 has a first protruding member 38 and a second protruding member 39 which are mechanically coupled thereto and which are aligned so that they are optically coupled to the first and second optical sensors 36 and 37. The first and second optical sensors 36 and 37 provide electrical signals to a control unit which provides a current for driving the first bi-directional motor 16.

Referring now to FIG. 6 a second embodiment of the printing apparatus 10 includes a movable carrier 14 which uses a first magnetic plate 58, which is disposed in a similar position as the first print head stop 27 of the first embodiment, and a second magnetic pulse 59, which is disposed in a similar position as the second print head stop 29 of the second embodiment, in conjunction with a ferromagnetic print wire casing 60. The rotatable print head 13 is pivotally coupled by the axial rod 24 about its center of gravity so that it is free-turning. Each of the first and second magnetic plates 58 and 59 maintains the rotatable print head 13 in its printing alignment with either the first or second platen 17 or 18. The movable carrier 14 also has a first solenoid 61 with a ram 62 and a second solenoid 63 with a ram arm 64. Each of the ram arms 62 and 64 knocks the rotatable print head 13 away from either the first or second magnetic plate 58 or 59 thereby causing the rotating head 13 to rotate into the other magnetic plate 59 or 58.

Figure 7:
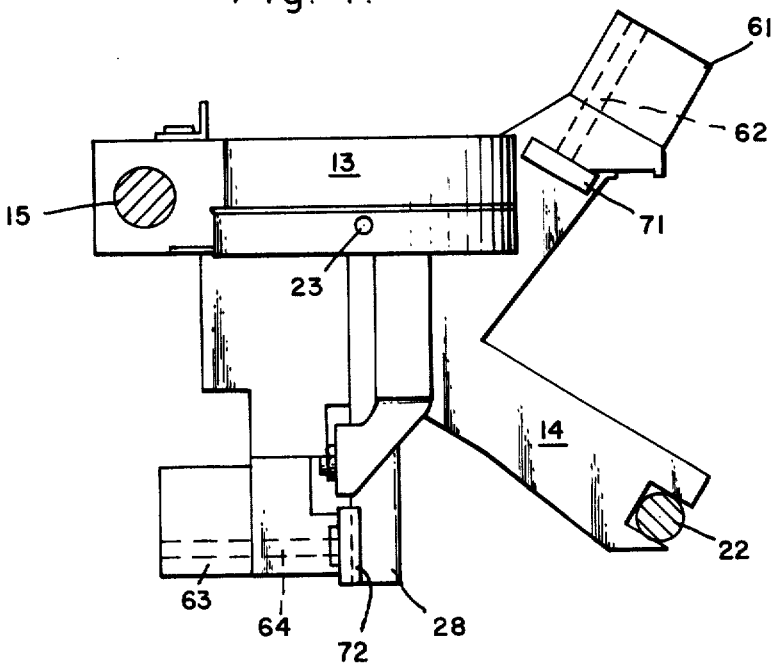
FIG. 7 is a side cross-sectional view of a movable carrier of a third embodiment of the multiple print station printing apparatus which uses a pair of solenoids and a pair of mechanical latches.

Referring to FIG. 7 a third embodiment of the printing apparatus 10 is similar to the second embodiment of the printing apparatus 10 except that it uses a first mechanical latch 71 and a second mechanical latch 72 to maintain the rotatable print head 13 in its printing alignment with either the first or second platen 17 or 18.

From the foregoing it can be seen that a rotatable print for use with a multiple print station printing apparatus has been described. Accordingly, it is intended that the foregoing disclosure and showing made in the drawing shall be considered only as illustrations of the present invention. Furthermore, it should be noted that the sketches are not drawn to scale and that distances of and between the figures are not to be considered significant. The invention will be set forth with particularity in the appended claims.

What is claimed is:

1. A rotatable print head in combination with a multiple print station printing apparatus comprising:

a. a print head;

b. a movable carrier to which said print head is pivotally coupled so that said print head may rotate substantially an angle of 90°;

c. a frame;

d. first driving means for bi-directionally and laterally moving said movable carrier in a direction which is parallel to the axis of rotation of said print head;

e. a first platen which is rigidly coupled to said frame and the print surface of which is disposed in a first plane which is substantially vertical and parallel to the axis of rotation of said print head; and f. a second platen which is rigidly coupled to said frame and the print surface of which is disposed in a second plane which is substantially horizontal and parallel to the axis of rotation of said print head;

g. an axial rod fixedly coupled to said print head and pivotally coupled to said movable carrier with said axial rod being aligned with the center of gravity of said print head; and h. rotating means for rotating said axial rod in order to rotate said print head mechanically coupled to said movable carrier;

i. first latching means for latching said print head in its printing alignment with said first platen;

j. second latching means for latching said print head in its printing alignment with said second platen;

k. first impacting means for impacting said print head so that said print head is pushed free from said first latching means; and l. second impacting means for impacting said print head so that said print head is pushed free from said second latching means whereby said print head may rotate independently of said first driving means into printing alignment with either said first platen or said second platen.

2. A rotatable print head in combination with a multiple print station printing apparatus according to claim 1 wherein said first and second latching means comprise:

a. a first mechanical latch which is mechanically coupled to said movable carrier and which is disposed adjacent to said first platen, said first mechanical latch being able to secure said print head in printing alignment with said first platen; and b. a second mechanical latch which is mechanically coupled to said movable carrier and which is disposed adjacent to said second platen, said second mechanical latch being able to secure said print head in printing alignment with said second platen.

3. A rotatable print head in combination with a multiple print station printing apparatus according to claim 1 wherein said print head has a wire casing which is formed from a ferromagnetic material and wherein said first and second latching means comprise:

a. a first magnetic plate which is disposed adjacent to said first platen and which is mechanically coupled to said movable carrier; and b. a second magnetic plate which is disposed adjacent to said second platen and which is mechanically coupled to said movable carrier whereby either said first or second magnetic plate may magnetically engage said wire casing of said print head.

* * * * *